US005454168A

United States Patent [19]

Langner

[11] Patent Number: 5,454,168

[45] Date of Patent: Oct. 3, 1995

[54] BORE SIGHTING SYSTEM AND METHOD

[76] Inventor: F. Richard Langner, 9856 E. Aster Dr., Scottsdale, Ariz. 85260

[21] Appl. No.: 189,515

[22] Filed: Jan. 31, 1994

[51] Int. Cl.[6] ..... F41G 3/32; G01B 11/26

[52] U.S. Cl. ..... 33/234; 33/241; 356/153

[58] Field of Search ..... 33/233, 234, 241, 33/506; 356/153

[56] References Cited

U.S. PATENT DOCUMENTS

| | | | |
|---|---|---|---|
| 953,696 | 4/1910 | Konig . | |
| 2,773,309 | 12/1956 | Elliot | 33/234 |
| 3,074,172 | 1/1963 | Cooper . | |
| 3,734,627 | 5/1973 | Edwards | 356/153 |
| 3,782,832 | 1/1974 | Hacskaylo | 33/234 X |
| 4,079,534 | 3/1978 | Snyder . | |
| 4,295,289 | 10/1981 | Synder . | |
| 4,481,561 | 11/1984 | Lanning . | |
| 4,530,162 | 7/1985 | Forrest et al. | 33/228 |
| 4,665,622 | 5/1987 | Idan | 33/241 |
| 4,676,636 | 6/1987 | Bridges et al. | 356/153 |
| 4,825,258 | 4/1989 | Whitson | 356/153 |
| 4,879,814 | 11/1989 | Wallace et al. | 33/234 |
| 5,001,836 | 3/1991 | Cameron et al. | 33/234 |
| 5,031,349 | 7/1991 | Vogel . | |
| 5,040,885 | 8/1991 | Simms | 33/241 |
| 5,060,391 | 10/1991 | Cameron | 33/234 |
| 5,068,969 | 12/1991 | Siebert | 33/241 |
| 5,301,436 | 4/1994 | Johnston | 33/506 |

OTHER PUBLICATIONS

Redfield Rifle and Pistol Scope Instructions, pp. 1–31, (no date).

*Primary Examiner*—Alvin Wirthlin
*Attorney, Agent, or Firm*—LaValle D. Ptak

[57] ABSTRACT

A bore sighting apparatus and method includes a light source contained within a housing, which is in the form of a stepped cylindrical insert placed in the firing chamber of the firearm. The housing is in the form of a series of interconnected stepped cylindrical portions corresponding to the firing chambers of different calibers of firearms, with the largest portion being located at the rear of the firing chamber. Light is projected from the housing through the bore of the barrel and through the muzzle to a target placed at a pre-established distance from the muzzle. Calibrated points are marked on the target; and the sights of the firearm are adjusted to the calibrated points to effect the bore sighting of the firearm for a specific range.

20 Claims, 2 Drawing Sheets

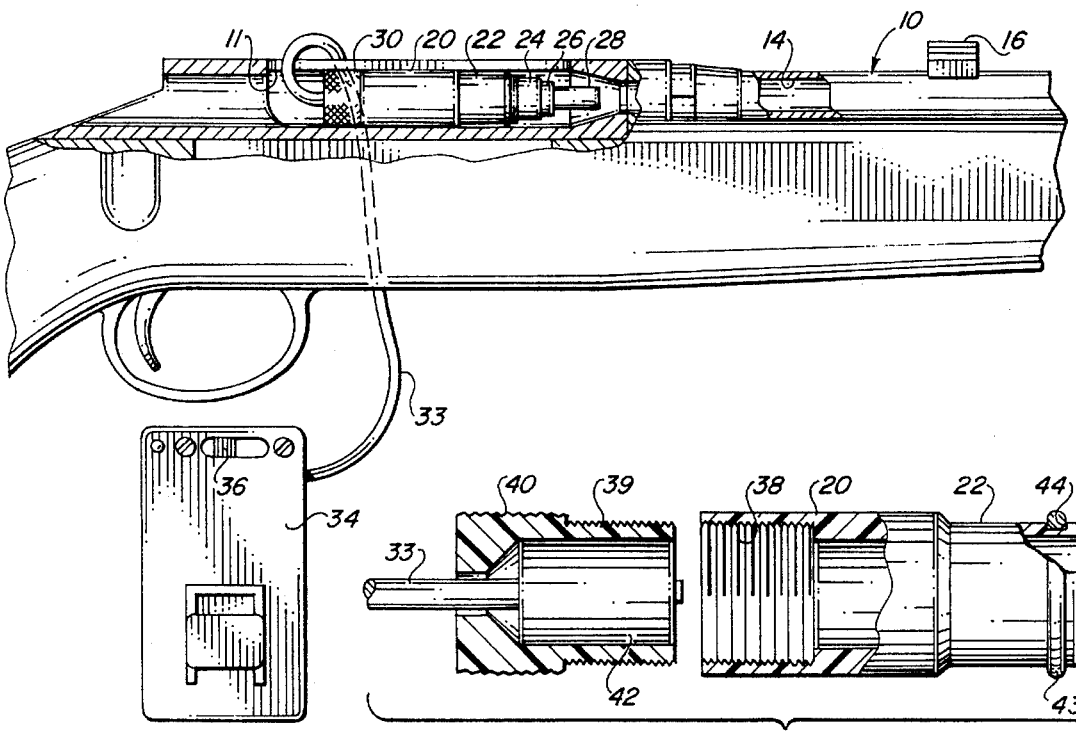
FIG. 1
FIG. 3
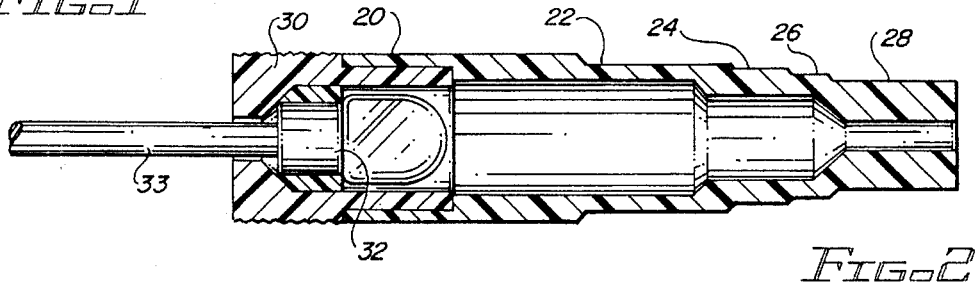
FIG. 2
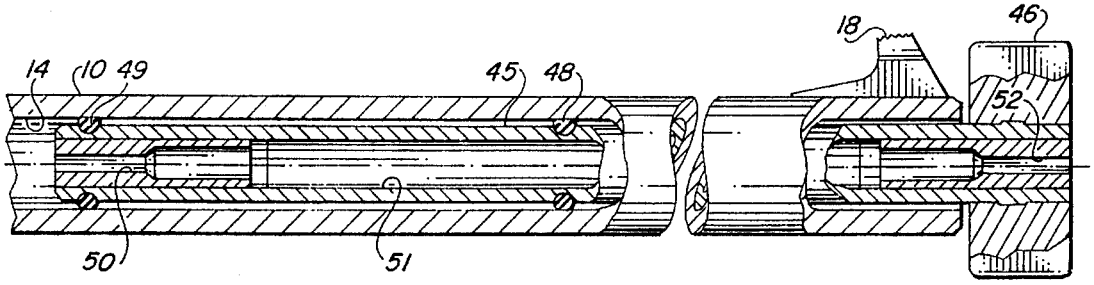
FIG. 4
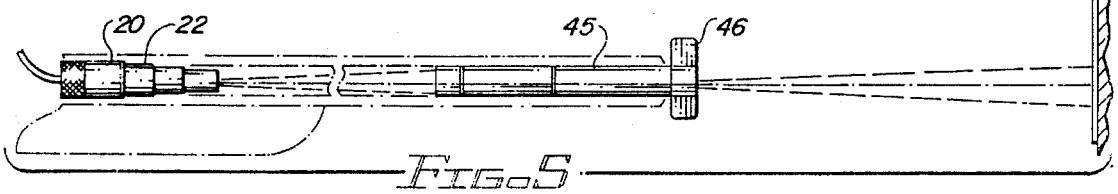
FIG. 5

BORE SIGHTING SYSTEM AND METHOD

BACKGROUND

In "sighting in" firearms such as rifles, handguns, shotguns, muzzle loaders, machine guns and cannons, for example, it is necessary to adjust the sights of the firearm at a pre-established angle with the bore of the barrel of the gun or firearm where the angle is determined by the distance from the muzzle of the firearm to the target, and by the trajectory of the bullet or projectile fired by the firearm. In its most basic form, this was accomplished by mounting the firearm on a fixed stand or in a fixed position relative to a sighting-in target. In the past, the target was placed at the actual final desired distance from the firearm; and the test shot was fired. The point on the target where the bullet or projectile entered the target then was aligned with the sights (whether iron sights or a telescope sight). After this was done, a second shot was fired, and the procedure was repeated until the point of entry of the bullet or projectile aligned with the cross hairs or cross points of the sights. In many cases, a number of shots needed to be fired in order to effect the sighting in procedure.

For each different range or target distance, a separate sighting in procedure needed to be followed. Obviously, a significant amount of ammunition needed to be expended simply to sight in the firearm; and the sighting in needed to be effected in a place where the firing of the actual bullet or projectile from the firearm over the desired distance could be safely effected. The result was a relatively time consuming, costly and potentially dangerous sighting in technique.

U.S. Pat. No. 4,825,258 is directed to a device for sighting in rifles and similar firearms, without requiring the expenditure of several rounds of ammunition to effect the sighting in operation. The apparatus of this patent consists of a mounting assembly formed as a body of revolution and having a head portion, a mandrel portion, and a cylinder portion including an expansion tube or expandable arbor. The expandable arbor is inserted into the muzzle end of the gun bore, and is secured in an axial position; so that it aligns with the central axis of the gun bore. A light spot generating device is mounted in axial alignment with the mounting assembly head portion and the mandrel; so that a light beam projected to a distant target provides a sighting reference for an associated scope or mechanical sight on the rifle.

Another type of bore sighter has a mandrel or arbor, which is inserted into the muzzle end of the bore of the rifle. A bore sighter with grid lines in it is mounted in an offset position on the arbor, in alignment with the scope or sights of the rifle. Once all of these parts have been secured together, the rifle is placed on a suitable fixed support; and the reticle of the telescopic sights of the rifle are aligned with the cross hairs of a graduated reticle in the bore sighter. The particular alignment is made in accordance with the indication on the grid for the desired range. Once this has been done, sighting in by means of the firing and adjusting of live ammunition is effected to make the final adjustments. Once the final adjustments are made, the bore sighter once again is mounted on the rifle by inserting the arbor or mandrel into the end of the muzzle; and the recorded reticle position, where the cross hairs of the telescopic sight align with the graduated grid reticle in the bore sighter, is made for future reference. Using the scope adjustments, correction for bullet drop at a specific distance, provided the trajectory of a specific load is known, can be made. Each graduation on the bore sighter grid is equivalent to a particular drop at one hundred yards. Consequently, when the scope reticle is below the grid center, the gun will shoot high to compensate for the drop or trajectory of the load.

Some types of sighting devices employ a laser beam or light beam mounted on the firearm sights; so that the beam indicates the alignment of the sights vis a vis the target. U.S. patents directed to this technique are the patents to Vogel U.S. Pat. No. 5,031,349; Idan U.S. Pat. No. 4,665,622; Snyder U.S. Pat. No. 4,295,289; Snyder U.S. Pat. No. 4,079,534.

Other techniques have been employed for projecting a light through the gun barrel or firearm bore. The light is directed toward a target and is viewed through the firearm sight. Azimuth and elevation adjustments then are made in order to bring the projected light and the sight adjustments into proper alignment. A relatively complex device for accomplishing this purpose is described in the patent to Cameron U.S. Pat. No. 5,060,391. This device employs an optical assembly, a beam splitter, and an illumination source in an enclosure. The illumination source is used to provide a visible light, which is directed by the beam splitter into the firearm bore, which is illuminated from the muzzle to the chamber. This illumination is viewed through the firearm optical sight; and the proper adjustments are made to bring the images of the muzzle and chamber into coincident alignment. When this is accomplished, the cross hair of the firearm optical sight is adjusted to bring the cross hair into alignment with the muzzle, bore and chamber images.

Another patent to Edwards U.S. Pat. No. 3,734,627 discloses an apparatus for aligning aircraft guns using a laser. The laser is mounted in a gun barrel; and the laser beam is used to locate a reference point for determining the adjustments needed in aligning the guns with respect to the gun sight. The device of this patent is not readily adaptable to hand-held firearms of various calibers.

In the U.S. patent to Lanning U.S. Pat. No. 4,481,561, a flashlight is used for bore sighting with a long-barrelled shotgun or rifle. The flashlight itself includes a cartridge case, with an ejector rim and a primer opening in the base, and a sidewall defining an open front end. A battery and light bulb are located within the case; and a switch pin is placed in the primer opening to complete the circuit for illuminating the bulb. When the breech of the gun is closed, a spring coupled with the switch pin is moved to energize the light bulb.

It is desirable to provide a simple bore sighting device and method, which provides accurate bore sighting, using a device capable of utilization with a range of firearms of different calibers, and which quickly and effectively facilitates the bore sighting adjustments of the sights on the firearm.

SUMMARY OF THE INVENTION

It is an object of this invention to provide an improved method for bore sighting a firearm.

It is an additional object of this invention to provide an improved bore sighting system for a firearm.

It is another object of this invention to provide an improved, easy-to-use bore sighting apparatus for use with firearms of different calibers.

It is a further object of this invention to provide an improved portable, compact, simple, easy-to-use device for effecting the bore sighting of a firearm.

In accordance with a preferred embodiment of this invention, a method for bore sighting a firearm includes the steps of securing the firearm in a fixed position. A target then is located a predetermined distance from the muzzle of the firearm, and has a center location for alignment with the firearm muzzle. A housing carrying a light source is placed in the firing chamber of the firearm to project a light through the barrel. The housing causes the light to be substantially centered in the firing chamber and on the axis of the barrel, from which it is projected onto the target center. The target is marked with horizontal and vertical cross lines, the vertical cross line of which passes through the target center. The horizontal cross line is offset from the target center by a predetermined amount, correlated with the predetermined distance from the muzzle of the firearm. The sights of the firearm then are aligned with the cross lines on the target to effect the desired bore sighting for the target distance represented by the distance the target is from the muzzle of the firearm and by the offset of the horizontal cross line from the center of the target.

An apparatus for effecting the bore sighting method includes a light source mounted in a stepped cylindrical housing, which has diminishing stepped cylindrical sections in it corresponding to different chamber sizes as determined by the calibers of firearms with which the device is to be used. The apparatus is designed to fit into the firing chamber of the firearm, with the smaller end of the device directed toward the barrel. A light source in the device then projects the light through the bore of the barrel, onto the target.

BRIEF DESCRIPTION OF THE DRAWINGS

FIG. 1 is a side view of a preferred embodiment of the invention, showing the position of its use in a firearm;

FIG. 2 is a cross-sectional view of a preferred embodiment of the invention;

FIG. 3 is a partially broken away cross-sectional view of another embodiment of the invention;

FIG. 4 illustrates a muzzle adapter, which is used in conjunction with the embodiment shown in FIG. 3;

FIG. 5 is a diagrammatic representation of the use of the device shown in FIGS. 1, 3 and 4;

DETAILED DESCRIPTION

Figure 7:
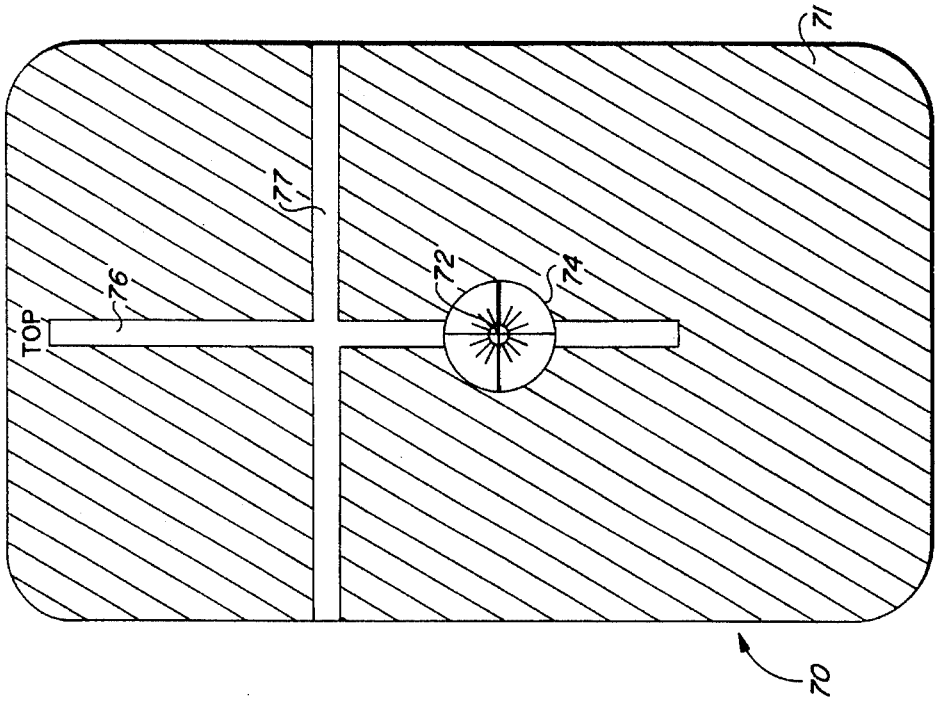
FIG. 7 illustrates a target for use in conjunction with the device shown in FIGS. 1, 3, 4 and 5.

Reference now should be made to the drawings, in which the same reference numbers are used throughout the different figures to designate the same components. FIG. 1 illustrates the use of a preferred embodiment of the invention, in conjunction with a firearm illustrated as a bolt-action rifle (with the bolt removed) having a barrel 10 and a firing chamber 11 in it. A rear metal sight 16 is shown; but the rifle may use a telescopic sight (not shown) mounted on the top of the barrel 10 in a conventional manner.

To effect bore sighting of the rifle with a minimal amount of firing live ammunition, a bore sight light emitter housing in the form of a stepped cylindrical member has five interconnected tapered cylindrical sections 20, 22, 24, 26 and 28 of decreasing diameter, with the largest diameter section 20 located at the rear of the firing chamber 11 and the smallest diameter section 28 located at the forward end of the firing chamber. The different steps 22 through 28 are selected to conform to different internal diameters of firing chambers for different caliber rifles or firearms.

When the housing 20–28 is inserted into the firing chamber 11 and then pushed forward toward the open end of the bore 14 through the barrel 10, the section 22 through 28 of the housing which conforms to the internal diameter of the firing chamber 11 for the caliber of the rifle, wedges against the wall of the firing chamber 11 to firmly seat the housing 20–28 in place. The tolerances of the tapered external diameters of each of the sections 22, 24, 26 and 28 of the light emitter housing are selected to cause it to fit closely into the firing chamber 14 of the rifle to securely hold and align the light emitter in place in the rifle in the center of the firing chamber 11. In this position, the hole through the center of the end section 28 is aligned with the axis of the bore 14 of the barrel 10.

As illustrated most clearly in FIG. 2, an end section 30 is made to slip fit into the left-hand end of the section 20 of the housing. This section has a knurled outer surface to facilitate its withdrawal from the housing section 20. The section 30 also has a light bulb 32 mounted in it in any suitable fashion. An electrical connector 33 connects the bulb 32 to a battery operated power source 34, which may include an on/off switch 36 in it. The batteries in the power source 34 are chosen to be suitable for powering the bulb 32, and typically may be a pair of 1.5 Volt "A—A" battery cells, or four "C" battery cells, as required by the light bulb 32.

In the use of the device shown in FIGS. 1 and 2, a defocused laser or an incandescent bulb 32 is employed; and it projects light through an opening in the right-hand end of the section 28 into the bore 14 of the barrel 10 of the rifle. Since this is not a collimated light, the light passing through the opening in the section 28 spreads out in the barrel, and expands to a circle approximately four and one-half inches in diameter, at a distance of approximately twenty-five feet from the barrel.

Figure 6:
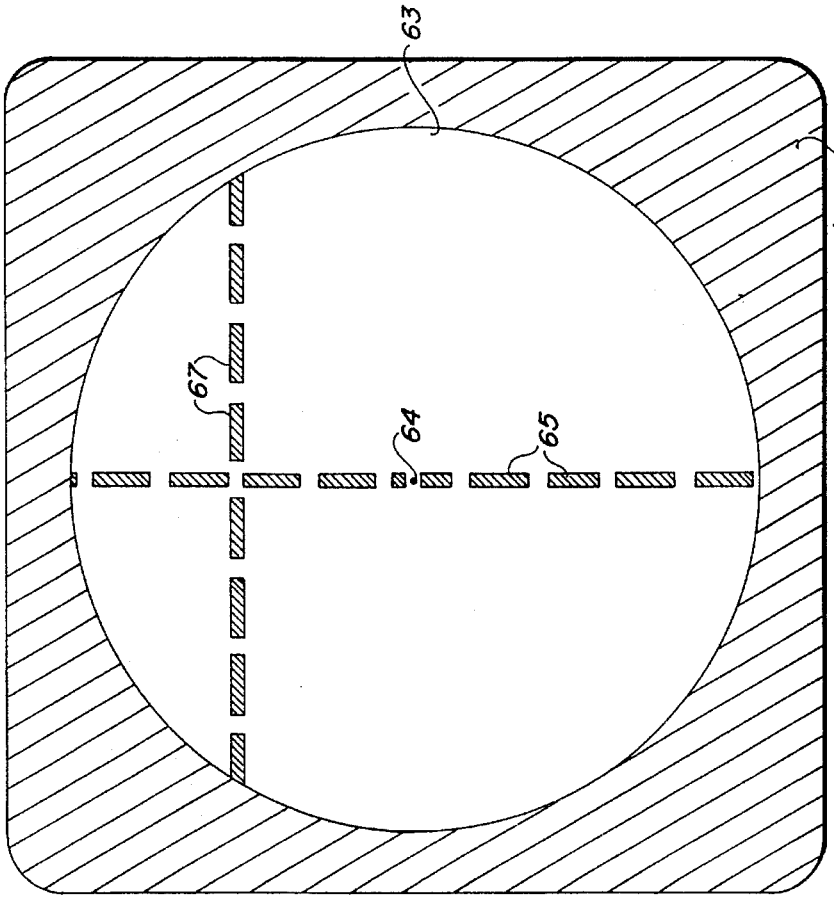
FIG. 6 illustrates one form of a target for use in conjunction with the device of FIGS. 1 and 2.

To accomplish the sighting in or bore sighting of a rifle using this embodiment of the invention, a target of the type shown in FIG. 6 is employed. The rifle of FIG. 1 is placed on a fixed support, with the muzzle end of the barrel 10 located a pre-established distance, typically twenty-five feet, from the target. The target 60 typically is a square target, approximately six and one-half inches, made of a dark (for example, black or brown) non-reflective surface 61. A reflective circle 63 is placed in the center of the target; and this circle has a diameter of approximately five and one-half inches. In FIG. 6, the center of the target is indicated at 64. A dashed vertical black or opaque line 65 extends across the target through the center 64; and a horizontal dashed dark (for example, black or brown) line 67, intersects the vertical dashed line 65 at a location offset from the target center by a pre-established amount, determined in accordance with the desired range and bullet load being employed. This line 67, for some firearms, is located above the center point 64; and for other firearms may be located below the center point 64, depending upon the trajectory and other characteristics of the load which is to be projected from the firearm undergoing the bore sighting operation.

When the light source of FIG. 2 is used, the light projected from the end of the muzzle 10 is a circle of light (as mentioned above). The target 60 is placed to cause the center of this light circle to be located at the center point 64 of the target. The sighting in of the rifle then is effected by adjusting either iron sights (open or peep), or a scope (regular or LED DOT type) with the crossed dash lines 65 and 67 on the target. If a cross hair scope is employed, the vertical and horizontal cross hairs in the scope reticle are aligned, respectively, with the vertical dashed line 65 and horizontal dashed line 67 on the target. When this alignment is correct, only a solid line (the scope reticle) may be seen on the target. Proper sighting in of the sights then have been effected. Obviously, if a scope is not used, but if open or peep iron sights are employed, the intersection point for these sights is the intersection of the dashed lines 65 and 67 on the target 60.

After this sighting in has been effected, the rifle (or other weapon) then is fired at a target located at the desired distance for which the sighting in target 60 is calibrated. For example, in the foregoing illustration, the target was indicated as being located at 25 feet from the muzzle of the rifle. The sighting in, which is being effected by means of the target 60, however, may be for a desired final target located at 100 yards (a typical hunting distance, for example). It is necessary to correlate the particular sighting in target 60, its distance from the muzzle of the rifle, and the offset of the horizontal line 67 with the particular range, caliber, and load which is to be used in the firearm. The first shot at a target located at the desired range should occur very close to the bulls eye. Final adjustments then are made by firing actual rounds of ammunition at the desired range.

The embodiment shown in FIGS. 3, 4 and 5 functions much in the same manner as the one described in conjunction with FIGS. 1 and 2. In the embodiment of FIGS. 1, 3, 4 and 5, however, a focused laser or collimated light source 42 is used in place of the defocused laser or incandescent bulb 32, shown in FIG. 2. Also in the embodiment shown in FIG. 3, the end portion in which the laser 42 mounted may be an externally threaded end portion having threads 39, which fit into an internally threaded receiving portion in the section 20 of the light emitter housing. A knurled outer part 40, corresponding to the knurled portion 30 of the device of FIG. 2 is used to thread the external threads 39 into the internal threads 38 to mount the laser 42 securely in the center of the housing 20–28 in alignment with the axis of the hole through the end of the section 28. To assist in centering the housing of the embodiment of FIG. 3, "O" rings are located at the forward ends (right-hand ends as viewed in FIG. 3) of each of the tapered sections 22, 24, 26 and 28. One such "O" ring 43, seated in a groove 44 on the section 22, is shown in FIG. 3. The other sections also have similar "O" rings (not shown). In all other respects, the device of FIGS. 1, 3, 4 and 5 operates in the same manner described above for the device of FIGS. 1 and 2, with the switch 36 providing power from the power pack 34 through the leads 33 to the laser 42. To further ensure a narrow beam projection from the laser 42 through the muzzle of the barrel 10, a muzzle adapter 45, with a handle 46 on its right-hand or outside end, is inserted into the muzzle end of the barrel 10, as indicated in FIGS. 4 and 5. This muzzle adapter is sized to fit into the bore 14 of a particular caliber of firearm; and a different muzzle adapter for different bore sizes may be employed. The purpose of the muzzle adapter is to ensure that the light beam (laser) is centered within the bore 14. The external diameter of the portion 15, which is inserted into the bore 14, is chosen to be slightly less than the internal diameter of the bore 14, and the adapter is centered in the bore 14 by means of a pair of resilient "O" rings 48 and 49, illustrated most clearly in FIG. 4.

As illustrated, a small diameter cylindrical aperture 50 is located at the left-hand end of the muzzle adapter 15; and another similar cylindrical aperture 52 is located at the right-hand or muzzle end of the adapter, extending through the handle and stop 46, which facilitates the insertion and withdrawal of the muzzle adapter into and out of the barrel 10 of the rifle. These apertures 50 and 52 are aligned with, and are smaller in diameter than, the aperture through the end of the section 28 of the housing. Thus, light, projected from the laser 42 on the axis of the bore 14 of the barrel 10 of the rifle, passes through the aperture in the section 28 of the housing, and then through the apertures 50 and 52, to be projected on a target.

When the focused laser 42 of FIG. 3 is used, along with a muzzle adapter of the type shown in FIGS. 4 and 5, the target 70 of FIG. 7 is employed, instead of the target 60 of FIG. 6. The target 70 is similar in size to the target 60, and is made primarily of a black or opaque surface 71. A center spot 72, which is selected to be the projection spot for the collimated laser beam from the laser light source 42, is provided in a circle 74 approximately three-quarter inch in diameter. A vertical bar or line 76 passes through the center 72 and the center of the circle 74, as illustrated in FIG. 8. A horizontal bar or line 77 is offset from the center 72. This offset is by an amount which is chosen in accordance with the characteristics of the firearm with which the bore sighter is used, the distance the target 70 is placed from the end of the muzzle for the bore sighting operation, and the trajectory and other characteristics of the load which will be used in subsequent firing of the firearm at the desired distance which the offset of the horizontal line 77 with the center 72 is desired to effect. The lines 76 and 77 are reflective or white cross lines against the dark background 71 of the remainder of the target 70.

The set up and operation of the bore sighting, using the target of FIG. 7, are much the same as the one described above in conjunction with the target 60 shown in FIG. 6. The rifle or other firearm is placed in a fixed standard, with the muzzle mounted horizontally and pointed toward the target 70. The target 70 is located at a pre-established distance from the muzzle (25 meters for military targets, or 25 feet for commercial targets) in a plane which is perpendicular to the axis of the bore 14 through the barrel 10 of the rifle. The spot of the projected laser light is centered on the spot 72 of the target 70. The target 70 is secured in position, with the line 76 extending vertically and the line 77 extending horizontally. The cross hairs of the telescopic sight or the cross points of an iron sight are aligned with the crossings of the lines 76 and 77 on the target to provide the desired offset. Once this has been accomplished, the bore sighter housing 20–28 is removed from the firing chamber of the weapon. Final sighting-in is effected by actual firing of rounds of ammunition at a distant target in the same manner described above for the embodiment of FIGS. 1 and 2.

While specific materials and colors have been described for the targets 60 and 70, it is to be understood that some targets may be reflective, and others may be non-reflective. The targets 60 and 70 may be produced in different colors to enhance the viewing of the spot of light, whether the embodiment of FIG. 2 is used or the embodiment of FIG. 3 is used. Clearly, the targets may be constructed of paper, cardboard, fabric or any other suitable material. The distance at which the targets 60 and 70 are placed from the muzzle of the weapon depends on the required use, and the load and other characteristics of the weapon which is being sighted in by means of the bore sight system and method described above. By way of example, military sighting-in targets usually are placed at standard twenty-five meters from the muzzle, and the weapon sights are adjusted accordingly. Other commercial targets, however, typically are placed twenty-five feet from the muzzle, as described above.

The targets are marked with the specific calibrated points by the crossings of the horizontal lines 67 or 77, with the vertical lines 65 or 76, as described above, for the particular calibrated points used to adjust the sights (for ultimate "in use" targets generally located much greater distances from the muzzle of the firearm). As a result, for some bore sighting the cross point of the horizontal lines 67 or 77 is located above the center of the target bulls eye. For other calibrations, the cross line 67 or 77 is located below the center of the target bulls eye. Once all of the parameters of the load, the caliber, and the firearm are established, however, the lines 67 and 77 may be accurately placed on targets 60 or 70 for use with a specific firearm, located a specific distance from the muzzle, with consistent bore sighting results obtained.

As noted above, the device may be used to fit any type of weapon, including rifles, handguns, shotguns, muzzle loaders, machine guns and cannons. The techniques which are employed are the same. Obviously, different sizes of light emitter housings are employed for different ones of these firearms. The overall function, however, is the same in all cases. It also should be noted that in addition to being capable of use with various types of sights, the system also is ideal for night vision sights, because it readily can be seen by night vision systems. For example, the system may be used for bore sighting night vision rifle scopes using an infrared laser 42 as the light source to be projected onto the target 70.

Various other changes and modifications may be made by those skilled in the art to perform substantially the same function in substantially the same way, to achieve substantially the same result, without departing from the true scope of the invention as defined in the appended claims.

I claim:

1. A method for bore sighting a firearm having adjustable sights and a barrel, with a firing chamber located at one end and a muzzle at the other end, said method including the steps of:

securing the firearm in a fixed position;

locating a target, having a center at a predetermined distance from the muzzle of the firearm;

placing a housing having a non-collimated light source in the firing chamber of the firearm to project light through the barrel, with the light substantially centered on the axis of the barrel said housing being in the form of a stepped hollow cylindrical member with at least two axially aligned sections therein including a first section of a first predetermined external diameter and a second section of a lesser predetermined external diameter coupled with said first section by a surrounding shoulder, selecting one of said predetermined external diameters of said first and second sections corresponding with the caliber of the internal diameter of the firing chamber of said firearm;

centering the light projected from the barrel of the firearm onto the target center;

marking the target with horizontal and vertical cross lines, the vertical cross lines passing through the target center, and the horizontal cross lines offset from the target center by predetermined amounts correlated with respect to said predetermined distance; and adjusting the sights to align with a selected cross line on the target.

2. The method according to claim 1 wherein the light source is an incandescent light source.

3. The method according to claim 2 further including the step of coating the target around the center thereof with a reflective material.

4. The method of according to claim 3 wherein the light source is a laser light source.

5. The method according to claim 4 further including the step of placing an insert in the muzzle end of the barrel with an aperture located on the axis of the barrel for alignment with light projected from the light source.

6. The method according to claim 1 further including the step of coating the target around the center thereof with a reflective material.

7. Apparatus for use in bore sighting a firearm including in combination:

a housing in the form of a stepped hollow cylindrical member with at least two axially aligned sections therein including a first section of a first predetermined external diameter and a second section of a lesser predetermined external diameter coupled with said first section by a surrounding shoulder, with said predetermined external diameters of said first and second sections selected to correspond with the internal diameter of the firing chambers of firearms of two different calibers;

a light source coupled with said first section of said housing; and a circular light-emitting aperture through said second section of said housing, with said light source projecting light through said aperture into the barrel of a firearm when said housing is inserted into the firing chamber of the firearm.

8. The combination according to claim 7 further including a power supply connected with said light source for energizing said light source.

9. The combination according to claim 8 further including a switch, and said power supply is connected through said switch to said light source.

10. The combination according to claim 9 further including a removable cap coupled with said first section of said housing; and wherein said light source is located within said removable cap.

11. The combination according to claim 10 wherein said light source is an incandescent light source.

12. The combination according to claim 10 wherein said light source is a laser light source.

13. The combination according to claim 7 wherein said housing has a third hollow cylindrical section axially aligned with said first and second sections, and having a light emitting aperture therethrough, with said first section having the largest external diameter, and said third section having the smallest external diameter, with said second section of an intermediate external diameter interconnected between said first and third sections, each of said sections externally connected with one another by means of surrounding shoulders.

14. The combination according to claim 13 further including a removable cap coupled with said first section of said housing; and wherein said light source is located within said removable cap.

15. The combination according to claim 14 further including a power supply connected with said light source for energizing said light source.

16. The combination according to claim 15 wherein said light source is a laser light source.

17. The combination according to claim 7 wherein said light source is an incandescent light source.

18. The combination according to claim 17 wherein said housing has a third hollow cylindrical section axially aligned with said first and second sections and having a light emitting aperture therethrough, with said first section having the largest external diameter, and said third section having the smallest external diameter, with said second section of an intermediate external diameter interconnected between said first and third sections, each of said sections externally connected with one another by means of surrounding shoulders.

19. The combination according to claim 18 further including a removable cap coupled with said first section of said housing; and wherein said light source is located within said removable cap.

20. The combination according to claim 18 further including a power supply connected with said light source for energizing said light source.

* * * * *